US010267092B2

(12) United States Patent
Dirksen et al.

(10) Patent No.: US 10,267,092 B2
(45) Date of Patent: Apr. 23, 2019

(54) SINGLE-ASSEMBLY SYSTEM AND METHOD FOR ONE-TRIP DRILLING, CASING, CEMENTING AND PERFORATING

(75) Inventors: Ron Dirksen, Spring, TX (US); Kehinde Samuel Adesina, Sugar Land, TX (US); Mark Edward Keller, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1099 days.

(21) Appl. No.: 13/496,307

(22) PCT Filed: Oct. 4, 2010

(86) PCT No.: PCT/US2010/051264
§ 371 (c)(1),
(2), (4) Date: Mar. 15, 2012

(87) PCT Pub. No.: WO2011/044012
PCT Pub. Date: Apr. 14, 2011

(65) Prior Publication Data

US 2012/0186816 A1 Jul. 26, 2012

Related U.S. Application Data

(60) Provisional application No. 61/249,177, filed on Oct. 6, 2009, provisional application No. 61/248,671, filed on Oct. 5, 2009.

(51) Int. Cl.
*E21B 7/20* (2006.01)
*E21B 7/00* (2006.01)

(52) U.S. Cl.
CPC ..... *E21B 7/208* (2013.01); *E21B 7/00* (2013.01)

(58) Field of Classification Search
CPC ..... E21B 7/20; E21B 7/208
See application file for complete search history.

(56) References Cited

U.S. PATENT DOCUMENTS 2,303,090 A 11/1942 Pranger
3,648,777 A 3/1972 Arterbury et al.
(Continued)

FOREIGN PATENT DOCUMENTS

WO WO-2011/038170 3/2011
WO WO-2011/044012 4/2011

OTHER PUBLICATIONS

Comeaux, Blaine C., et al., "Systems and Methods for Drilling Boreholes with Noncircular or Variable Cross-Sections", U.S. Appl. No. 61/514,333, filed Aug. 2, 2011.
(Continued)

*Primary Examiner* — D. Andrews
(74) *Attorney, Agent, or Firm* — Alan Bryson; Parker Justiss, P.C.

(57) ABSTRACT

Some system embodiments include: a casing string having a distal end with a latch assembly; and a drillstring latched within the casing string by the latch assembly, the drillstring having at least one tool for perforation and stimulation. A pressure while drilling tool and one or more packers may be provided in the drillstring to further enable the stimulation operation. Prior to perforation, the casing string is cemented in place via a cement valve, and the drillstring is unlatched and raised to the desired completion position. The perforation and stimulation process can be repeated to provide multiple completions. The drillstring can be removed from the borehole or seated in place to control production. Logging instruments can be included for steering and/or use in making completion decisions.

18 Claims, 5 Drawing Sheets

(56) References Cited

U.S. PATENT DOCUMENTS

| | | | | |
|---|---|---|---|---|
| 4,047,569 | A | 9/1977 | Tagirov et al. | |
| 5,812,068 | A * | 9/1998 | Wisler | E21B 7/068 175/40 |
| 7,234,542 | B2 | 6/2007 | Vail | |
| 7,475,742 | B2 | 1/2009 | Angman et al. | |
| 2004/0084189 | A1 | 5/2004 | Hosie et al. | |
| 2004/0118613 | A1 | 6/2004 | Vail, III | |
| 2006/0081401 | A1 * | 4/2006 | Miller et al. | 175/171 |
| 2007/0284106 | A1 * | 12/2007 | Kalman et al. | 166/298 |
| 2008/0202755 | A1 | 8/2008 | Henke et al. | |
| 2008/0264690 | A1 | 10/2008 | Khan et al. | |
| 2008/0302529 | A1 * | 12/2008 | Fowler et al. | 166/250.01 |

OTHER PUBLICATIONS

Dirksen, Ron et al., "PCT International Search Report and Written Opinion", Appl No. PCT/US11/43678, "NMR Tracking of Injected Fluids", filed Jul. 12, 2012. Dirksen, Ronald J., "Cooled-Fluid Systems and Methods for Pulsed-Electric Drilling", U.S. Appl. No. 61/514,299, filed Aug. 2, 2011.

Dirksen, Ronald J., "Pulsed-Electric Drilling Systems and Methods with Reverse Circulation", U.S. Appl. No. 61/514,319, filed Aug. 2, 2011.

Dirksen, Ronald J., "Systems and Methods for Directional Pulsed-Electric Drilling", U.S. Appl. No. 61/514,304, filed Aug. 2, 2011.

Dirksen, Ronald J., "Systems and Methods for Pulsed-Flow Pulsed-Electric Drilling", U.S. Appl. No. 61/514,312, filed 098/02/2011.

PCT International Search Report and Written Opinion, dated Dec. 1, 2010, Appl No. PCT/US10/51264, "Single-Assembly System and Method for One-Trip Drilling, Casing, Cementing, and Perforating", filed Oct. 4, 2010, 8 pgs.

PCT International Preliminary Report on Patentability, dated Apr. 9, 2012, Appl No. PCT/US2010/051264, "Single-Assembly System and Method for One-Trip Drilling, Casing, Cementing, and Perforating", filed Oct. 4, 2010.

* cited by examiner

SINGLE-ASSEMBLY SYSTEM AND METHOD FOR ONE-TRIP DRILLING, CASING, CEMENTING AND PERFORATING

CROSS-REFERENCE TO RELATED APPLICATIONS

The present application claims priority to U.S. Provisional Application No. 61/248,671, filed Oct. 5, 2009, and U.S. Provisional Application No. 61/249,177, filed Oct. 6, 2009, each titled "Single-Assembly system and Method for One-Trip Drilling, Casing, Cementing and Perforating", by inventors Ron Dirksen, Kehinde Adesina, and Mark Keller. These provisionals are hereby incorporated herein by reference.

BACKGROUND

Oilfield operators perform a series of operations to obtain a producing well. Illustrative operations include drilling a borehole, obtaining logging measurements, inserting casing, cementing the casing in place, perforating the casing at selected points, and fracturing the formation. These operations generally require the use of different downhole components, causing operators to conduct multiple insertions and removals ("trips") of the bottomhole assembly. Each trip requires an investment of time and resources, and hence operating methods requiring fewer trips are often regarded as advantageous.

BRIEF DESCRIPTION OF THE DRAWINGS

A better understanding of the various disclosed embodiments can be obtained when the following detailed description is considered in conjunction with the drawings, in which.

Figure 1:
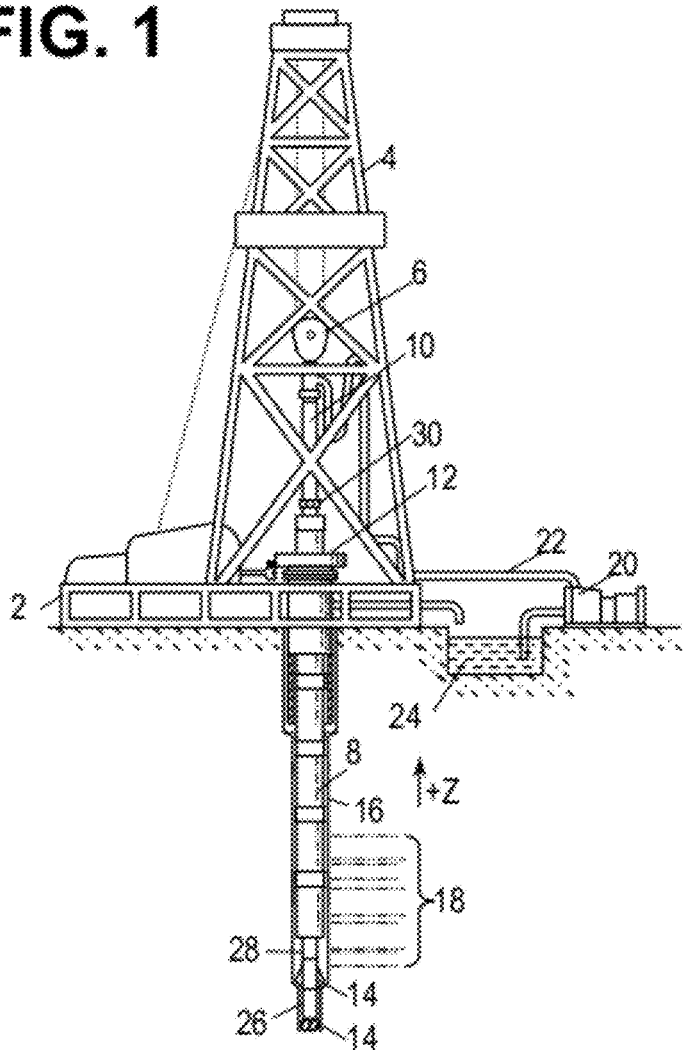
FIG. 1 shows an illustrative one-trip well creation environment.

While the invention is susceptible to various modifications and alternative forms, specific embodiments thereof are shown by way of example in the drawings and will herein be described in detail. It should be understood, however, that the drawings and detailed description are not intended to limit the disclosure, but on the contrary, the intention is to cover all modifications, equivalents and alternatives falling within the scope of the appended claims.

DETAILED DESCRIPTION

Accordingly, there are disclosed herein systems and methods for creating a well in as little as one trip. In at least some embodiments, the system includes a casing string having a distal end with a latch assembly. Latched to the casing string is a drillstring with a distal end that extends beyond the casing string. At the tip of the drillstring there is a drillbit (with an optional motor) and an underreamer having retractable blades to enable the drillstring to be withdrawn from the hole via the casing string after the casing has been cemented in place. A tool is included in the drillstring to perforate and stimulate the formation at one or more completion points as the drillstring is raised from the borehole. A pressure-while-drilling tool and one or more packers can be included in the drillstring to assist in the stimulation operations.

Certain method embodiments include: assembling a drillstring, latching the drillstring into a casing string, drilling a borehole with the combined string, cementing the casing string, perforating the casing string, and stimulating the formation. Each of these operations is performed with one trip of the drillstring into (and possibly out of) the hole. The drillstring can be assembled to include a drill bit, a motor, an underreamer, a suite of logging while drilling instruments, a cement valve, a displacement valve, a perforation/stimulation tool, one or more packers, a pressure-while-drilling tool, and a telemetry/control sub. The latch assembly that holds the drillstring to the casing can be further configured to close off the bottom end of the casing when the drillstring is pulled clear.

The disclosed systems and methods are best understood in the context of the environment in which they operate. Accordingly, FIG. 1 shows an illustrative one-trip drilling environment. A drilling platform 2 supports a derrick 4 having a traveling block 6 for raising and lowering a cased-drilling assembly (which includes a drillstring 8 latched within a casing string 9). A top drive 10 supports and rotates the cased-drilling assembly as it is lowered through the wellhead 12. A drill bit 14 and underreamer 15 are driven by a downhole motor 16 and/or rotation of the cased-drilling assembly. As bit 14 and underreamer 15 rotate, they create a borehole 17 that passes through various formations 18. A pump 20 circulates drilling fluid 22 through a feed pipe 24, through the interior of the drill string 8 to drill bit 14. The fluid exits through orifices in the drill bit 14 and flows upward through the annulus around the casing string 9 to transport drill cuttings to the surface, where the fluid is filtered and recirculated.

The drill bit 14, motor 16, and underreamer 15 are just pieces of a bottomhole assembly that includes one or more drill collars (thick-walled steel pipe) to provide weight and rigidity to aid the drilling process. Some of these drill collars include built-in logging instruments to gather measurements of various drilling parameters such as position, orientation, weight-on-bit, borehole diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes can alternatively be used. The orientation measurements can be combined with gyroscopic or inertial measurements to accurately track tool position.

The illustrated bottom-hole assembly includes a suite of logging tools 26 coupled to a downhole control module. As the bit 14 extends the borehole 20 through the formations, the logging tools 26 rotate and collect measurements that the downhole controller associates with tool position and orientation measurements. The measurements can be stored in internal memory and/or communicated to the surface. Moreover, the downhole controller can process the measurements and/or operate on instructions received from the surface to steer the bit 14. (To this end, the motor 15 can be part of a rotary steerable system or can incorporate some other steering mechanism.)

Figure 2:
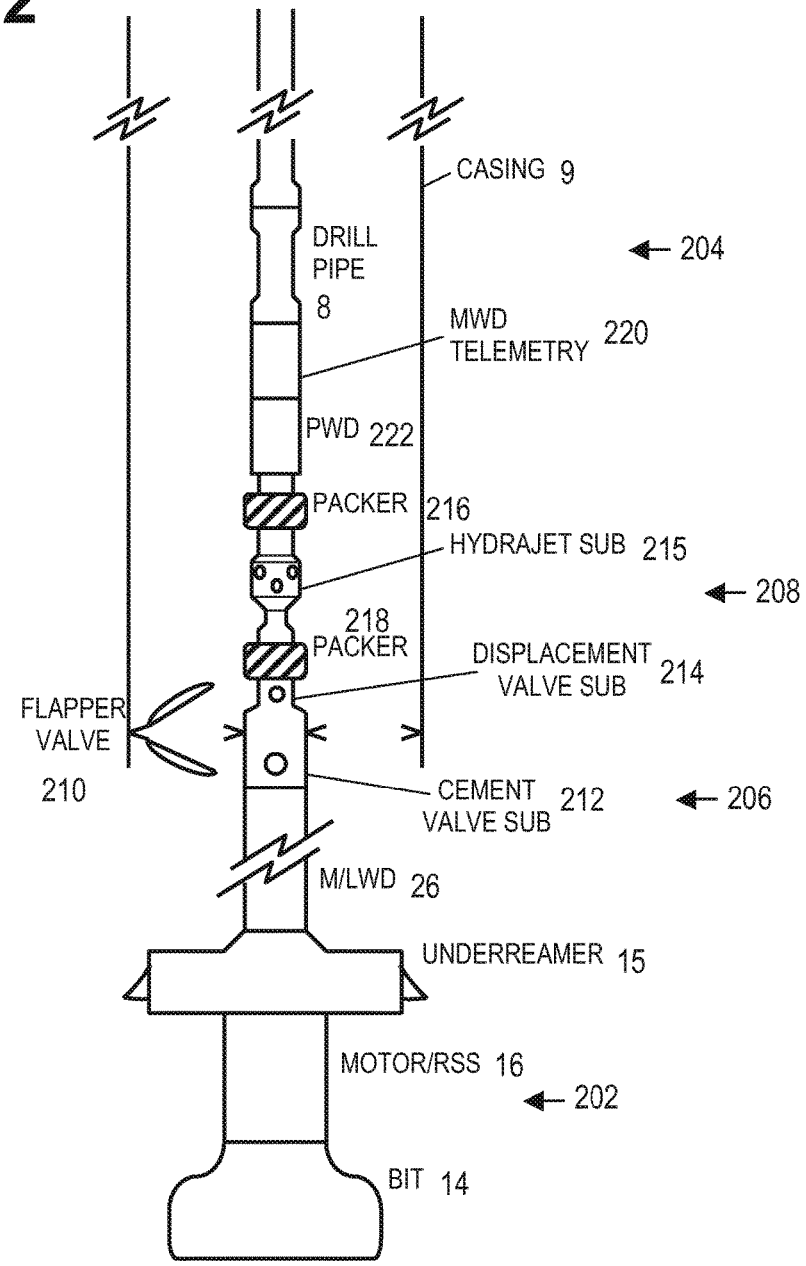
FIG. 2 shows an illustrative assembly that enables drilling, casing, cementing, and perforating operations to be performed in one trip.

FIG. 2 illustrates an illustrative one-trip assembly which includes a drilling subassembly 202, a casing subassembly 204, a cementing subassembly 206, and a perforation subassembly 208, each of which are described in turn below.

The drilling subassembly 202 illustrated in FIG. 2 includes a bit 14, a motor (optionally configured as part of a rotary steering system) 16, an underreamer 15, and a collection of logging while drilling (LWD) and measurement while drilling (MWD) tools 26. As the bit rotates, it extends the borehole, creating cuttings that are cleared from the hole by the flow of a gas or a fluid. In some embodiments, a surface pump 20 forces a fluid down through the interior of the drill string 8. The fluid exits through orifices in the bit 14 and flows upward through the annulus around the casing string 9, carrying the cuttings with it. Drilling rig operators know of a wide variety of available drill bits that are suited to the various drilling conditions that can be encountered downhole. The bit 14 can be rotated by a downhole motor 16 and/or by the rotation of the whole cased-drilling assembly by a motor located on the surface. The underreamer 15 has extendable cutters that, when extended, enlarge the borehole to accommodate the casing. The cutters can be retracted to enable the drilling assembly to pass through the interior of the casing at a later stage.

The drilling subassembly 202 further includes a collection of logging tools 26 that gather data on the formations 18 being penetrated, the size and configuration of the borehole 17, the position and orientation of the subassembly, and/or selected drilling parameters. A wide variety of logging tools are available and the particular combination selected is a matter of choice for the operator.

The casing subassembly 204 illustrated in FIG. 2 includes a casing string 9 and a latch-valve combination 210. The latch-valve combination 210 secures the casing string 9 to the drill string 8 and, while the drill string is in place, the latch-valve combination allows fluid to flow between the casing interior and the region below the casing. Once the latch is released and the drill string withdrawn, the valve seals the end of the casing to prevent such fluid flows. The valve can take various forms including a flapper valve configuration or a sliding sleeve configuration.

The cementing subassembly 206 illustrated in FIG. 2 includes a cementing valve 212. The cementing subassembly can further include one or more packers below the cementing valve 212 to direct the flow of cement into the annulus between the casing 9 and the borehole wall. The cementing valve 212 enables cement to flow from the interior of the drill string into the annulus outside the casing string.

The perforation subassembly 208 illustrated in FIG. 2 includes a displacement valve 214, a perforation tool 215 such as a hydra jet sub, and optional packers 216, 218 to isolate the region around the perforation tool. The displacement valve 214 enables the fluid inside the casing 9 to be displaced by a perforating and/or stimulation fluid while the operator waits for the cement to set. The hydra-jet sub 215 provides a powerful fluid jet that penetrates the casing 9 and cement at those points where the jet is directed. Under the proper conditions, the jet can even penetrate and/or fracture the formation near the borehole. Once the operator has perforated the casing and cement, the operator has the option to inflate the packers 216, 218 and raise the pressure in that region to fracture the formation and deposit proppants or other stimulation materials in the formation. These operations can be repeated many times, as desired, while the drill string is being drawn out of the hole.

The illustrated perforation subassembly 208 further includes a telemetry tool 220 and a pressure-while drilling (PWD) tool 222, though in some embodiments these tools are repositioned as part of a different subassembly. The telemetry tool 220 communicates with the surface during drilling operations to transmit measurement and status data, and to receive commands from the surface. In response to such commands, the telemetry 220 tool sends control signals to the various subassemblies to configure, trigger, and/or control their operations. For example, the telemetry tool can send steering signals to the rotary steering assembly 16 to direct the drilling along a specified direction. The underreamer cutters can be adjusted or retracted by the telemetry tool. The MWD and PWD measurement tools 26 can be turned on and off and reconfigured to optimize the way data is collected and communicated to the surface. The cement and circulation valves 212, 214 can be opened and closed and the casing latch 210 can be released. Packers (including packers 216 and 218) can be inflated and deflated, and the hydrajet 215 can be triggered. These are just some of the downhole control possibilities enabled by the telemetry module.

The telemetry module 220 can use any of the available telemetry techniques for communicating with the surface. Illustrative techniques include mud pulse telemetry, acoustic telemetry, electromagnetic telemetry, and wireline or wired-drillpipe telemetry.

Figure 3:
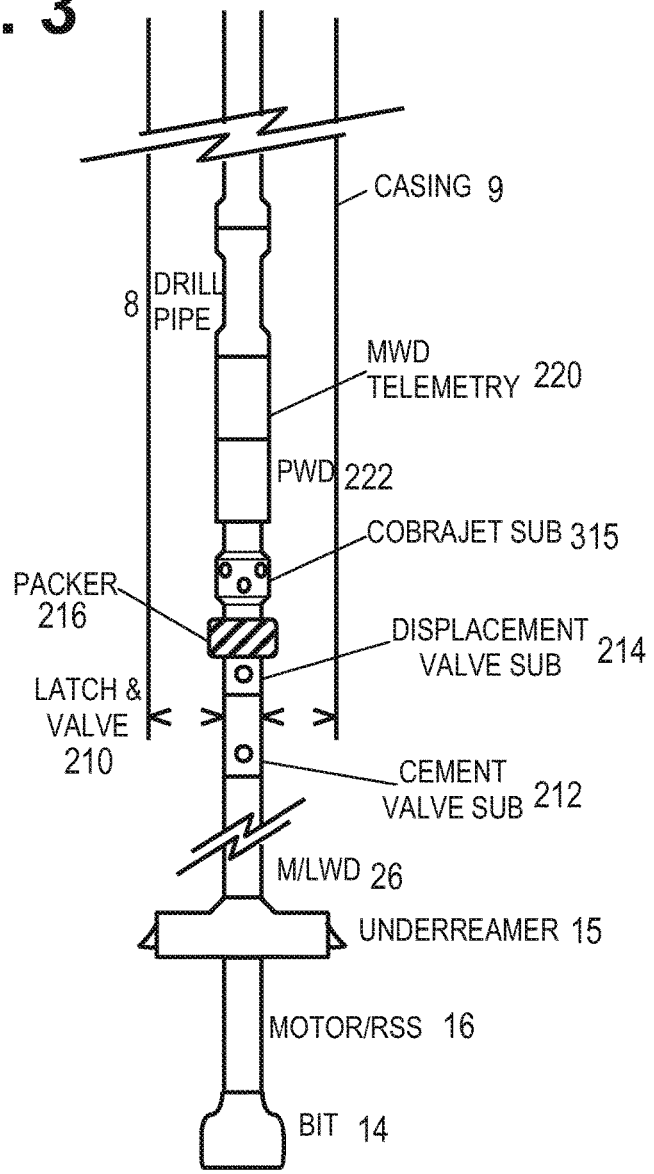
FIG. 3 shows an second illustrative one-trip assembly.

FIG. 3 shows an alternative embodiment in which a CobraJet Frac® service configuration is employed for perforation and stimulation. This configuration employs a single compression packer 216 below the perforation tool 315 rather than the straddle packer configuration shown in FIG. 2. The single packer is used to seal the annulus around the inner tubing string before the stimulation service is applied to the perforation from the surface via the annulus. The process can be repeated multiple times to efficiently perforate and stimulate multiple regions as the inner string is pulled from the hole.

It is noted that the inner string shown in FIGS. 1-3 need not extend to the surface. In at least some alternative embodiments, the bottom-hole assembly (comprising at least the drilling assembly) is anchored to the lower end of the casing and the casing is rotated to drill the hole in accordance with existing "drilling with casing" techniques such as those employed by Enventure or Tesco (See, e.g., U.S. Pat. No. 7,475,742 "Method for Drilling With Casing"). After the target depth has been reached (and before or after cementing operations), an inner string is run into the hole. The inner string optionally attaches to the bottom hole assembly and triggers its release for retrieval. In any event, the newly-inserted inner string provides the perforating technology (e.g., HydraJet), with optional stimulation operations, to complete the well at the desired locations. This inserted inner string can be equipped with logging tools for logging on the way in and/or logging on the way out, enabling measurement of cementing quality and formation parameters contemporary to the perforation decision process. (While this alternative embodiment adds one trip to the operation, there is nonetheless a substantial reduction in trips relative to the traditional process.)

Figure 4:
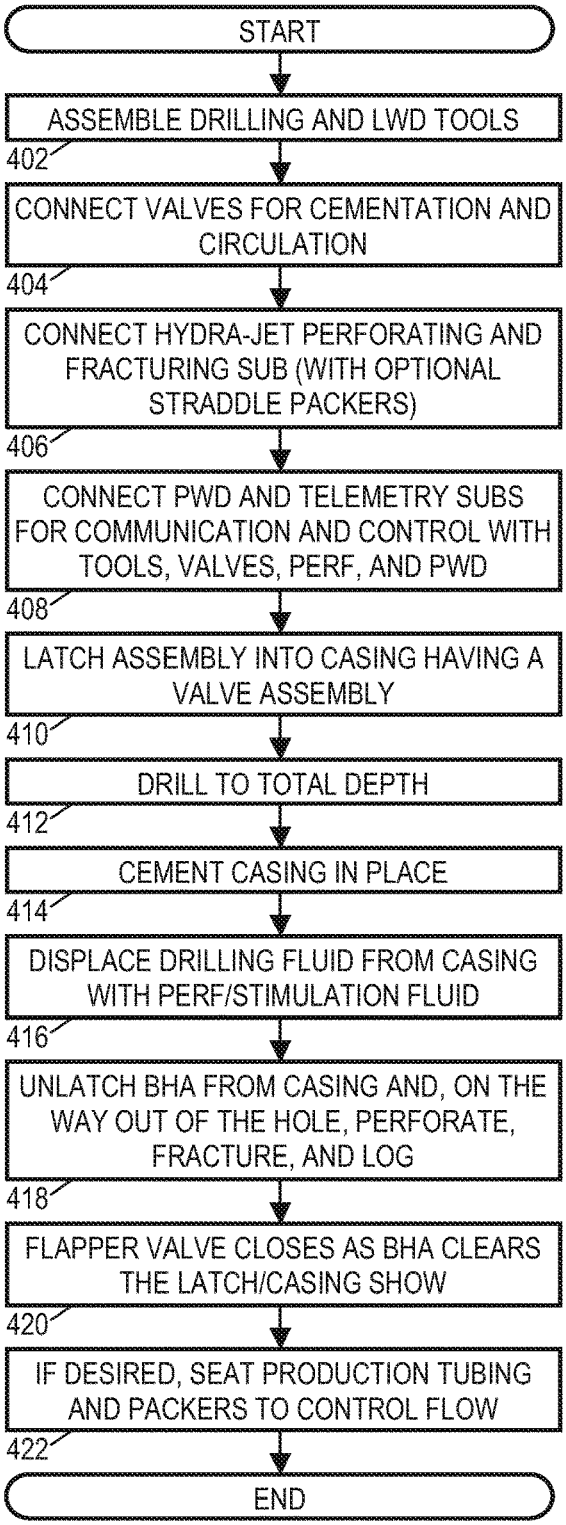
FIG. 4 is a flow diagram of an illustrative one-trip drilling, casing, cementing, and perforating method.

FIG. 4 shows a flow diagram of an illustrative method for performing a series of operations in one trip. The illustrative method can be performed to provide a well in only a single trip, or it can be conducted on a conventionally-drilled well that is nearing completion. In block 402, the operator constructs the drilling subassembly. As an example, the operator attaches a bit to a rotary steerable system, and in turn connects that to a collection of logging tools and an underreamer. In block 404, the operator attaches the drilling subassembly to a cementing subassembly, including a cementation valve and optional packer. In block 406 the operator attaches a perforating subassembly (including a circulation valve, packers in a straddle or isolation configuration, and a perforation tool sub). In block 408, a telemetry sub and optional instrumentation module (such as a PWD sub) are attached to complete a bottom-hole assembly (BHA). (In some cases, drill collars can also be added to provide additional weight and rigidity.) The BHA is then latched to a casing subassembly in block 410.

In block 412, the operator commences drilling with the combined assembly. In accordance with existing drilling practices, the operator can also gather logging data and steer the borehole along a desired path. As the drilling progresses, the operator adds joints of drill pipe and casing to lengthen the assembly. Once the target depth has been reached, the operator can immediately initiate a cementing operation in block 414 without having to trip the drill string out of the hole. The operator inflates selected packers to direct the flow of concrete to the annulus outside the casing, then opens the cementing valve and initiates a flow of cement. Once the cement is in place and it begins to set, the operator can initiate a flow of fluid through the displacement valve in block 416. The fluid that displaces the drilling fluid inside the casing can be a fluid for the perforation process. Additional or alternative fluids can be added after perforation for use during the stimulation/fracturing process.

Once the cement has set, the operator can unlatch the BHA in block 418. The operator also deflates any packers and retracts the underreamer's cutters before beginning to withdraw the drill string through the casing. At selected positions, the operator performs perforation operations to enable fluid to flow from the formation into the borehole. In at least some embodiments, the perforation is performed with a hydra jet sub, but other perforation tools could also be employed.

In many cases, it will be sufficient to simply perforate the casing and cement, but in other cases, the operator will want to stimulate the formation to increase production rates. Stimulation can take the form of fracturing, a technique in which the operator increases the pressure in the well bore to create and open fractures in the formation. This can be done using the hydra jet and/or placing a straddle packer around the perforations to define a region in which the pressure can be increased by supplying a relative incompressible fluid at a high pressure. (In the absence of a straddle packer configuration, the fracturing pressure will bear against the blow-out preventer "BOP" or the reverse circulation device "RCD".) In some cases, granular materials are added to the stimulation fluid to prevent fractures from re-closing as the pressures return to normal. Other suitable stimulation techniques are available and can be employed (e.g., chemical treatments).

As indicated by block 420, the casing subassembly can be provided with a flapper valve that closes as the BHA is withdrawn and the bit clears the casing terminus. In many cases, the foregoing operations are sufficient to create a productive well that flows without need for any intervention once the drill string has been removed.

In some cases, the operator may choose to insert a production tubing string as indicated by block 422. The production tubing string can be equipped with packers and valves to isolate desired regions, provide artificial lift, and/or regulate flows from the formation. In some alternative embodiments, the drill string is not be removed beyond the point where the last perforation operation is performed, but rather it is repositioned as need to be employed as production tubing. To this end, the drillstring can be assembled with additional packers, screens, and/or valves for zonal isolation and production control.

Figure 5:
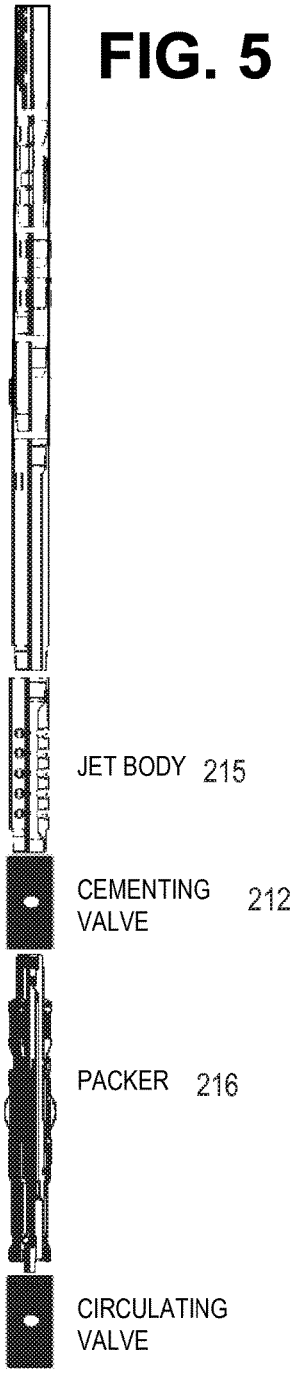
FIGS. 5 and 6 are alternative drillstring assemblies for use in a one-drip drilling, casing, cementing, and perforating method.
Figure 6:
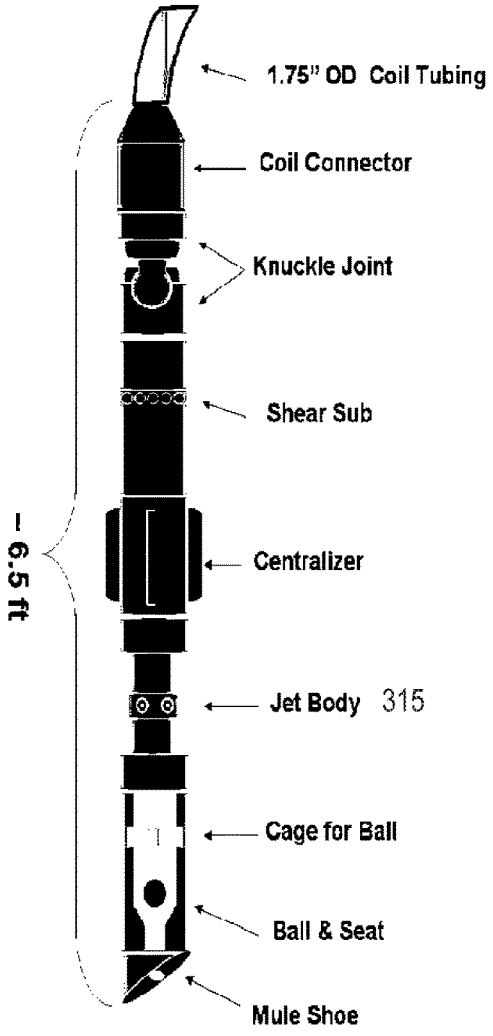

FIGS. 5 and 6 illustrate drilling string assemblies that can be employed as part of a one-trip drilling system. They can each be run on coiled tubing or jointed tubing. The cementing valve, circulating valve, and stimulation ports (the ports in the jet body) can be opened and closed independently of each other. The jet body nozzles (in FIG. 5) can be isolated when the cementing valve is opened. Cementing can be performed in a variety of ways, including through the cementing valve, the jet body ports, or even through the bit. A circulating valve is provided below the packer in order to flush the packer tool body free of cement. The cementing port can also be used for reverse circulation above the packer in the event of a screen out during fracture stimulation, so as to wash away the proppant accumulation that might otherwise make it difficult to release the packer.

The CobraMax tool configuration shown in FIG. 6 uses a sand plug to isolate between zones instead of using a packer element like the CobraJet tool of FIG. 5. As with FIG. 5, the jet body nozzles can be isolated while cementing. The captured ball and ported sub can be replaced with a circulating valve that can be independently activated as needed. The position of the centralizer/stabilizers affects the drilling angle building tendency.

Numerous variations and modifications will become apparent to those skilled in the art once the above disclosure is fully appreciated. It is intended that the claims be interpreted to embrace all such variations and modifications.

What is claimed is:

1. A single-trip well creation system for use in a wellbore that comprises:

a casing string having a distal end with a latch assembly, wherein the latch assembly includes at least a latch and a valve;

a drillstring latched within the casing string by the latch assembly, wherein the drillstring includes at least:

a perforation tool;

a pressure while drilling tool adjacent to and uphole from the perforation tool;

a telemetry tool adjacent to and uphole from the pressure while drilling tool;

a packer operable to seal an annular space between the casing string and the drillstring adjacent to and downhole of the perforation tool to enable formation stimulation via the perforation tool;

a displacement valve adjacent to and downhole of the packer;

a cement valve downhole of the displacement valve; and at least one measurement while drilling tool positioned downhole from the packer and the latch assembly;

wherein the pressure while drilling tool, the at least one measurement while drilling tool, and the perforation tool are configured to be turned on and off and reconfigured by the telemetry tool during drilling.

2. The system of claim 1, wherein the drillstring further comprises a second packer operable to seal an annular space between the casing string and the drillstring uphole of the perforation tool.

3. The system of claim 1, wherein the displacement valve is between the latch assembly and the perforation tool.

4. The system of claim 3, wherein the cement valve is between the latch assembly and a drill bit.

5. The system of claim 4, wherein the drillstring further comprises a bottomhole assembly control module that operates the displacement valve and the cement valve in response to communications from uphole.

6. The system of claim 1, wherein the drillstring further comprises:

one or more logging while drilling tools that project beyond the distal end of the casing string;

an underreamer that also projects beyond the distal end of the casing string, wherein the underreamer has blades that are retractable to enable the underreamer to pass along a bore of the casing string;

a drill bit at a distal end of the drillstring; and a motor that drives the drill bit.

7. The system of claim 1, wherein the latch assembly operates to close the distal end of the casing string when the drillstring clears the latch assembly.

8. A single-trip well creation method for use in a wellbore that comprises:

assembling a drillstring to include at least: a drill bit; a cement valve; a perforation tool; a packer in the drillstring between the perforation tool and a latch assembly, wherein the latch assembly includes at least a latch and a valve, a pressure while drilling tool adjacent to and uphole from the perforation tool, and telemetry tool adjacent to and uphole from the pressure while drilling tool, a displacement valve adjacent to and downhole of the packer, a cement valve downhole of the displacement valve, and at least one measurement while drilling tool downhole from the packer, wherein the pressure while drilling tool and the at least one measurement while drilling tool, and the perforation tool are configured to be turned on and off and reconfigured by the telemetry tool during drilling;

latching the drillstring into a casing string with the latch assembly;

drilling a borehole with the drillstring and casing string latched together;

cementing the casing string in place using the cement valve; and using the perforation tool to perforate the casing and to stimulate a formation around the perforations.

9. The method of claim 8, wherein said displacement valve in the drillstring is positioned between the perforation tool and the latch assembly, and wherein the method further comprises using said displacement valve to displace drilling fluid with stimulation fluid.

10. The method of claim 9, wherein the method further comprises operating the packer to seal an annular space between the drillstring and the casing string before using the perforation tool to stimulate the formation.

11. The method of claim 10, wherein said telemetry module in the drillstring is configured for monitoring stimulation of the formation.

12. The method of claim 8, further comprising:

unlatching the drillstring from the casing string after said cementing; and raising the drillstring to align the perforation tool with a desired completion point.

13. The method of claim 12, wherein the latch assembly closes off a distal end of the casing string as the drillstring is raised clear of the latch assembly.

14. The method of claim 12, wherein said raising and using operations are repeated to perforate the casing at multiple points.

15. The method of claim 8, further comprising removing the drillstring from the casing string.

16. The method of claim 8, further comprising seating the drillstring for use as a production tubing string.

17. The method of claim 8, wherein said assembling includes: providing a downhole motor in the drillstring to drive the drill bit; and providing an underreamer having blades that are retractable.

18. The method of claim 8, wherein said assembling includes: providing one or more logging while drilling tools in the drillstring, and wherein the method further comprises transmitting logging data uphole during said drilling.

* * * * *